United States Patent [19]

Del Fabro et al.

[11] Patent Number: 5,009,097

[45] Date of Patent: Apr. 23, 1991

[54] PLANT OR APPARATUS UTILIZING A UNIVERSAL STRAIGHTENING-BENDING MACHINE

[75] Inventors: Marcello Del Fabro; Giorgio Del Fabro, both of Reana Del Rojale, Italy

[73] Assignee: M.E.P. Macchine Elettroniche Piegatrici S.p.A., Italy

[21] Appl. No.: 438,771

[22] Filed: Nov. 17, 1989

[30] Foreign Application Priority Data

Nov. 23, 1988 [IT] Italy ..... 83532 A/88

[51] Int. Cl.[5] ..... B21D 7/024

[52] U.S. Cl. ..... 72/387; 72/131; 72/161; 72/217; 72/307

[58] Field of Search ..... 72/214–219, 72/386–388, 404, 446, 131, 130, 161, 294, 307

[56] References Cited

U.S. PATENT DOCUMENTS

| | | | |
|---|---|---|---|
| 1,272,552 | 7/1918 | Spencer | 72/217 |
| 3,052,277 | 9/1962 | Stegmann | 72/380 |
| 3,440,859 | 4/1969 | Holtzhauer | 72/404 |
| 3,991,600 | 11/1976 | Del Fabro | 72/217 |
| 4,485,664 | 12/1984 | Richards | 72/386 |
| 4,561,279 | 12/1985 | Wears | 72/218 |

FOREIGN PATENT DOCUMENTS

| | | | |
|---|---|---|---|
| 262294 | 12/1960 | Australia | 72/387 |
| 368725 | 11/1982 | Austria . | |
| 2723846 | 12/1977 | Fed. Rep. of Germany . | |
| 2918813 | 11/1980 | Fed. Rep. of Germany | 72/217 |
| 1364770 | 5/1964 | France . | |
| 293445 | 7/1965 | Netherlands | 72/386 |

*Primary Examiner*—Daniel C. Crane

*Attorney, Agent, or Firm*—Curtis, Morris & Safford

[57] ABSTRACT

A straightening-bending plant or apparatus utilizing a universal straightening-bending machine, preferably associable with wire stock feeding mechanism, in which the straightening-bending machine comprises in progressive order, on a pivotable working plane an hinging horizontal axis (Y—Y);

an advancing and straightening mechanism with opposed rolls to straighten and advance in longitudinal path the stock laying on the working plane (B), associated/able with an eventual guiding mechanism;

a cutting mechanism, laying on the same work plane (B), for cutting the stock material;

a bending mechanism for bending said stock material by means of a central anvil mechanism and bending nib, (7) rotating around; characterized in that the respective working plane pivoting mechanism is conceived to orient the working plane;

from a first approximately horizontal position ($\beta^\circ=90^\circ$)

to a second positive inclined position ($0^\circ<\beta^\circ<90^\circ$) in which the working plane faces frontally and upwards;

to a third vertical position ($\beta^\circ=0^\circ$) in which the working plane faces frontally, to a fourth negatively inclined position ($0^\circ<-\beta^\circ<90^\circ$) in which the working plane faces frontally and downwards, and wherein:

the respective pivoting axis (X—X) of the working table is displaced downwards in respect of the longitudinal stock material advancing path (Y—Y) when the working plane is oriented said third vertical position and said fourth negatively inclined position.

6 Claims, 4 Drawing Sheets

PLANT OR APPARATUS UTILIZING A UNIVERSAL STRAIGHTENING-BENDING MACHINE

BACKGROUND OF THE INVENTION

The present invention relates to a plant or apparatus utilizing a universal straightening - bending machine.

More specifically, this plant or machine is utilized for straightening and bending of rods or metallic wire and hence for the realization of small or large stirrups, and more particularly, for the bending and shaping of relatively long rods and even to the respective opposed extremities of the rods In the prior art, it is known that the straigntening of rods can be performed by special machines called straightening machines.

Less preferably, stirrup/bending machines that comprise even straightening means (e.g. AT-B-368725 in the name of EVG, Italian patent application in the name of same inventor IT-83342A/85 and IT-83426A/85 corresponding to EP-86102121.0) are used. These stirrup/-bending machines perform other functions than just straightening the rods. For instance, in AT-B-368725, straightening action is performed on the corresponding bending plane whereas in other solutions, the straightening action is performed on different planes, the bending plane in which lies the corresponding cutting and bending group being disposed more or less inclined to the vertical.

These types of machines, that performed the straightening action before the bending action, are inherently difficult for straightening and shaping of rods of notable lengthiness.

Other drawbacks of all this category of machines (known generally as stirrup machines), is that they cannot produce stirrups or shaped rods of great size since it is impossible to rotate lengthy and large diameter bars on a vertical or inclined plane.

Other drawbacks encountered by these machines for the production of small-size stirrups (for example, for reinforced concrete), for the reason of the presence of the bending journals and anvil means, is extremely difficult as the finished stirrups discharged must be collected and transferred to another location within the plant.

Further inconvenience lies in producting spiral stirrups formed by bending an axial bar for the respective support, this limiting the length of the spiral sliding in the bar.

Finally for the production of stirrups or relatively long rods, horizontal benches are used comprising:

a sole bending group wherein an extremity of the bars is first and then bent to scroll causing the bar near one extremity, and then finally bending the other opposed extremity, or two moveable adjustable bending groups for shaping contemporaneously contemporarily the two opposed extremities of the bar.

These benches are complex and designed for bending operations wherein the rods are shaped solely by manually or mechanical bending. These benches are not conducive to automatic feeding and straightening operations.

U.S. Pat. No. 3,052,277 (STEGMANN) discloses a bending machine with work bending table pivotable about a horizontal axis to move the work table in any desired inclination including angular displacement exceeding 90° relative to the horizontal plane. Although the Stegmann bending machine allows the table to be moved to a preferred working position, it does not provide a sufficient means for discharge of the produced stirrups.

OBJECTS OF THE INVENTION

An object of the present invention is to provide a universal straightening/bending machine which is capable of performing the operations, of the mentioned machines, thereby alleviating the need use different machines with different characteristics for each type of stirrup to be produce.

A further object of this invention is to provide a suitable means to discharge the stirrups produced which also utilizes a working table as suggested by U.S. Pat. No. 3,052,277 (STEGMANN) which is angularly displaceable for different applications.

Various other objects, advantages and features of the present invention will become readily apparent from the ensuing detailed description, and the novel features will be particularly pointed out in the appended claims.

This and others objects are achieved by the present invention which relates to a straightening-bending plant or apparatus utilizing a universal straightening-bending machine, including wire stock feeding means, the the straightening-bending machine includes in progressive order, on a pivotable working plane on hinging horizontal axis:

advancing and straightening means with opposed rolls to straighten and advance in longitudinal path said stock laying on the working plane, which can include subsequent guiding means;

cutting means, laying on the same working plane, for cutting said stock material;

bending means for bending said stock material by means of central anvil means and bending nib, rotating therearound; characterized in that the respective working plane pivoting means is conceived to orient said working plane or table:

from a first generally horizontal position, to a second positive inclined position in which the working plane faces forwardly and upwardly;

to a third vertical position in which the the working plane faces, to a fourth negatively inclined position in which the the working plane faces forwardly and downwardly, and wherein:

the respective pivoting axis of said working table is displaced downwardly in respect of the longitudinal stock material advancing path when the working plane is oriented in said third vertical and fourth negatively inclined positions;

such that the finished cut and bent stirrups are allowed to free-fall downwardly after the ends of the advancing stop material are bent and cut.

With this solution:

with the working table its horizontal position ($\beta^\circ=90^\circ$), it is rendered possible to straighten relatively long rods and to shape relatively long pieces constituting the same basis support plan for the straightened and/or shaped material;

with the working table in its vertical position ($\beta^\circ=0^\circ$) or its positively inclined position ($0^\circ<\beta^\circ<90^\circ$), it is possible to produce stirrups of medium size wherein discharging problems arise;

with the working table in its negatively inclined position from vertical ($0° < -\beta° \beta 90°$), is its possible to produce finished small or intermediate-sized stirrups which preferably fall to the ground or more preferably, into on a container position thereunder thereby avoiding the problems of restraining movement into respective journals or bending anvil.

Advantageously the present bending-straightening machine is capable of bending the stirrups in both clockwise or counter-clockwise direction, in such a way that it is possible, after and before the bending of head, the rod is advanced for the desired length, is cut and bend at the other opposed extremity.

In this way it is possible to utilize a sole bending group without needing further bending machines.

Downstream of the straightening-bending machine, a horizontal bench to support the entirety of the varying length advanced rods already bent so as the first extremity can be supported, in order to allow further working to such that it can be the opposite extremity to be cut and bent in further steps.

The working plane in the corresponding position of the straightening station is narrowed allowing the operator to accompany manually large bent shaped forms.

A second workbench with respective bending group can be used in conjunction with first machine for bending the opposed extremity of an already worked rod in sequentially steps.

BRIEF DESCRIPTION OF THE DRAWINGS

The detailed description, given by way of example, will best be understood in conjunction with the accompanying drawings in which.

Figure 1:
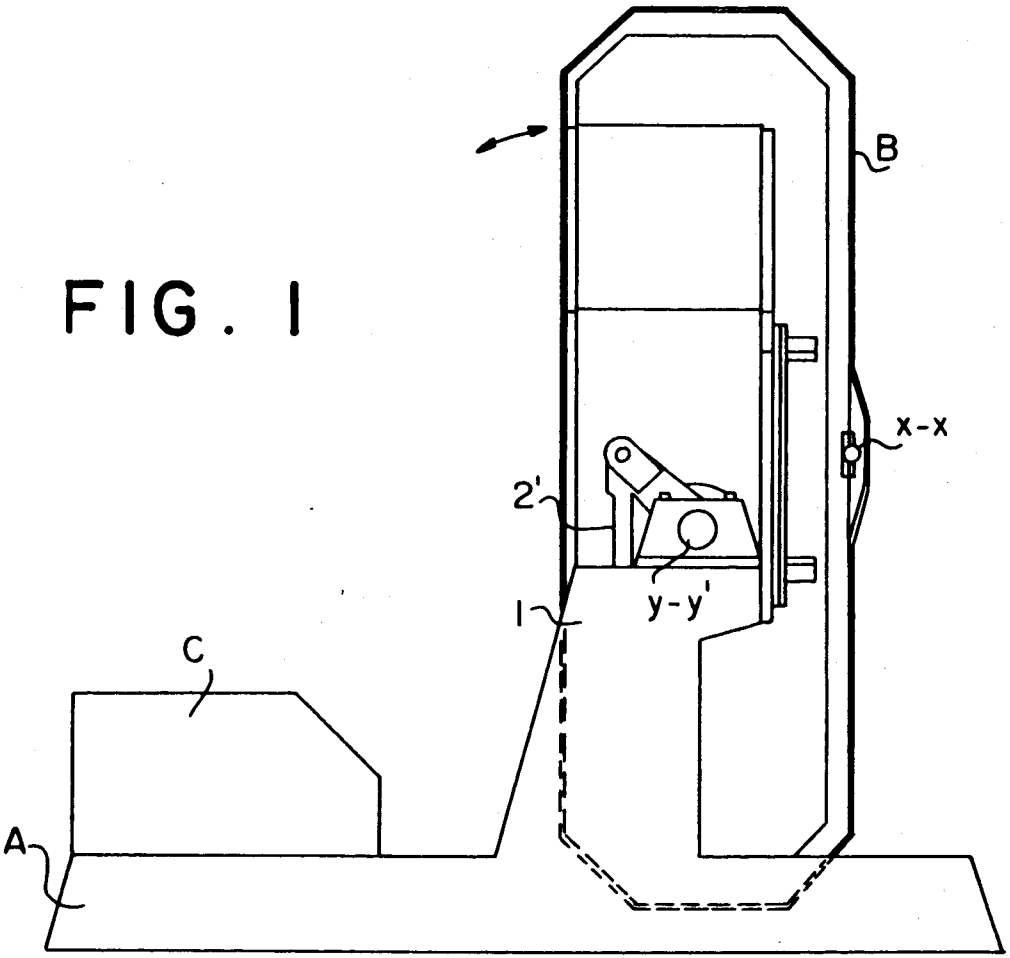
FIG. 1 is a side eve elevation view of a straightening-/bending machine in accordance with the present invention which is shown generally normal to the line of advancement of the material.
Figure 2:
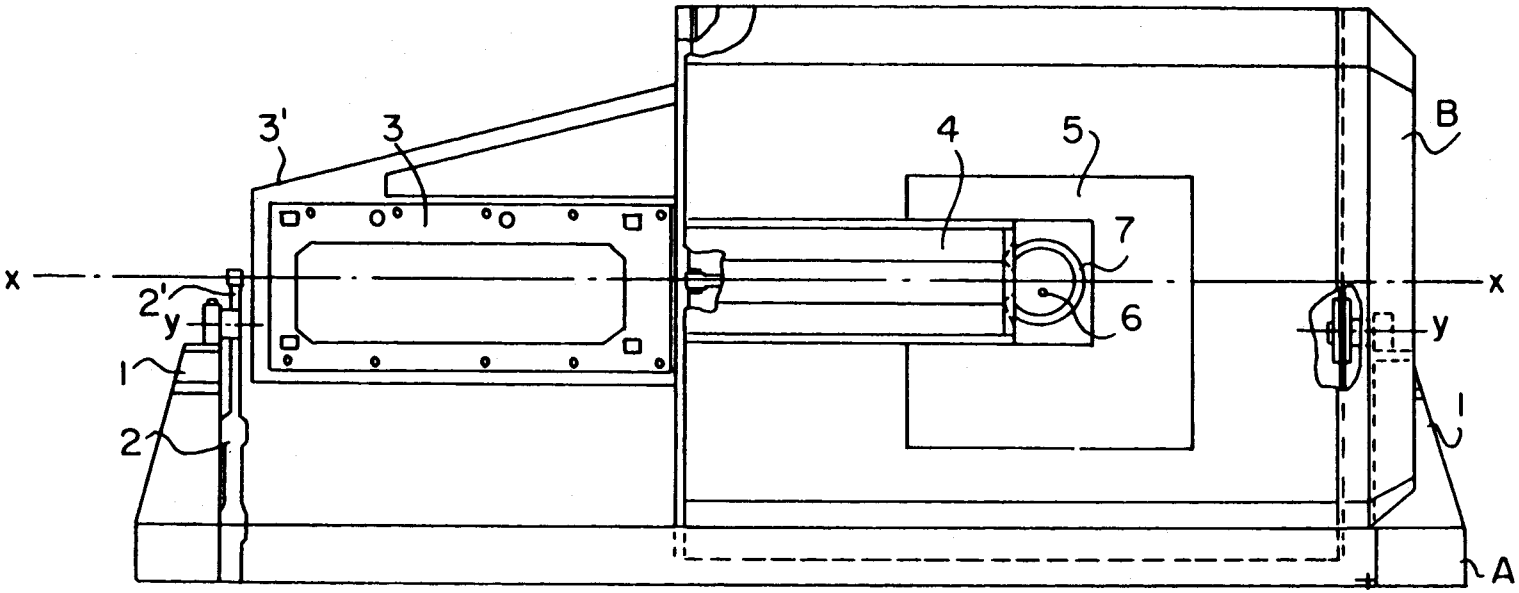
FIG. 2 is a front elevational view of the straightening-bending machine shown in FIG. 1.
Figure 3:
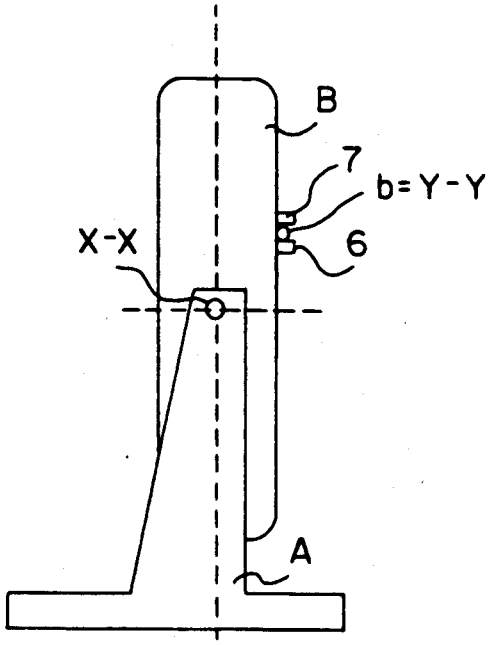
FIG. 3 through 7 and FIG. 4 are schematic views of the straightening-bending machine shown in FIG. 1 illustrating a working plane inclined in different positions.

Referring now to the drawings, wherein like numerals are used throughout, a straightening-bending machine is illustrated including a support structure (A) with laterally spaced-apart frame members (1) in which a working table (B) is pivotable on an horizontal axis (Y—Y), the rotation laterally spaced-apart frame members by means of a hydraulic cylinder (2—2'). Of the working table is provided includes:

a straightening group (3) housed within a tapered zone (3') that has an opening from the opposite side (S) permit an operator to work in horizontal condition;

advancing stock material (b) guide means (4);

a bending group (5) that includes cutting means (5') and bending means (5'') the last ones comprising:

a central anvil (6) that can position itself over or under (by means of retraction, displacement under the rod and reissuing from the other side) the stock material to be bent, and a peripheral bending nib (7) that can rotate both clockwise and counterclockwise and can retract itself and leaves passing from one side of the rod to the opposite side to allow clock-wise and counter clockwise bending actions.

Figure 4:
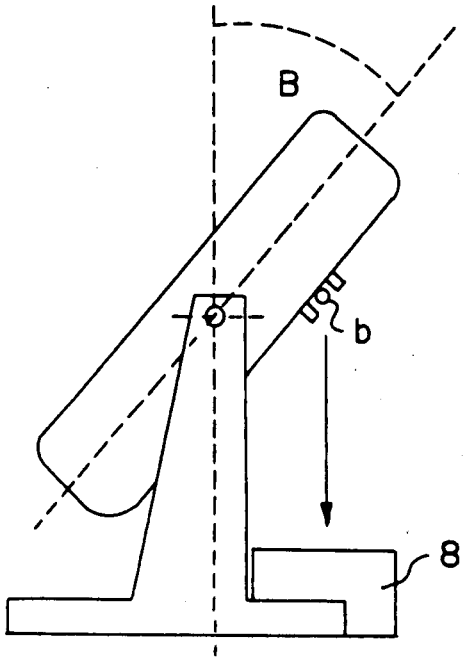
Figure 5:
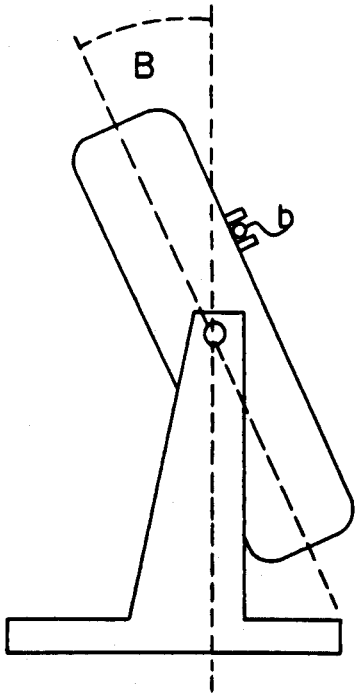
Figure 6:
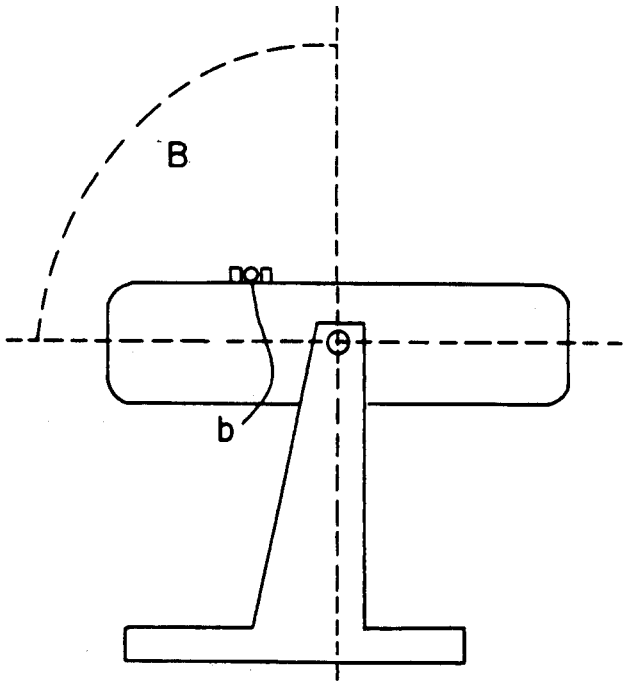
Figure 7:
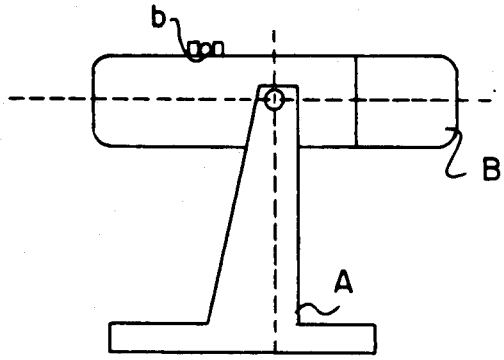
Figure 4:
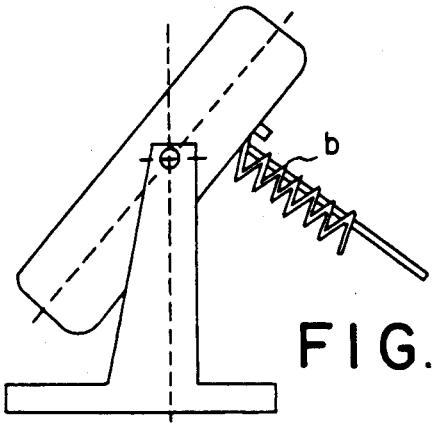
Figure 8:
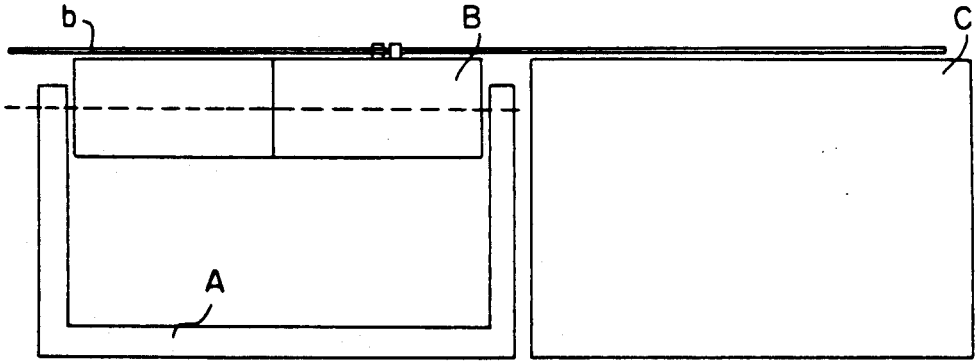
FIGS. 8 and 9 are schematic views illustrating the straightening-bending machine of this invention used in conjunction with working benches.

It is noticeable that the advancement path axis (X—X) of the row or stock material (b) is not coincident with the axis of rotation of the working table (Y—Y), but in working plane horizontally oriented and in a working plane vertically oriented, it is higher than the pivoting axis X—X to allow:

the work with a horizontal plan (for big and large shapes) over an support service (C).

the work with the negative inclination ($-\beta°$) for free freely discharging the stirrups into a container (8), thereby avoiding the restraint on the bending means. In this condition (see FIG. 4) circular spiral-shaped stirrups can be produced by means of an orthogonal support axis (FIG. 4') which further allows easy discharging.

The working system for relatively long rods is shown in FIG. (9), where after the bars (b) which have already been shaped is cut, it is further advanced for a predetermined length (same meters) in order to work the opposite extremity, while the advanced portion is supported by the adjacent supporting surface (C), this allows the opposite extremity to be bent from the same bending group (5'') by means of displacement of the central anvil 6 on the rod and rotation of the bending nib (7) counterclockwise.

Figure 9:
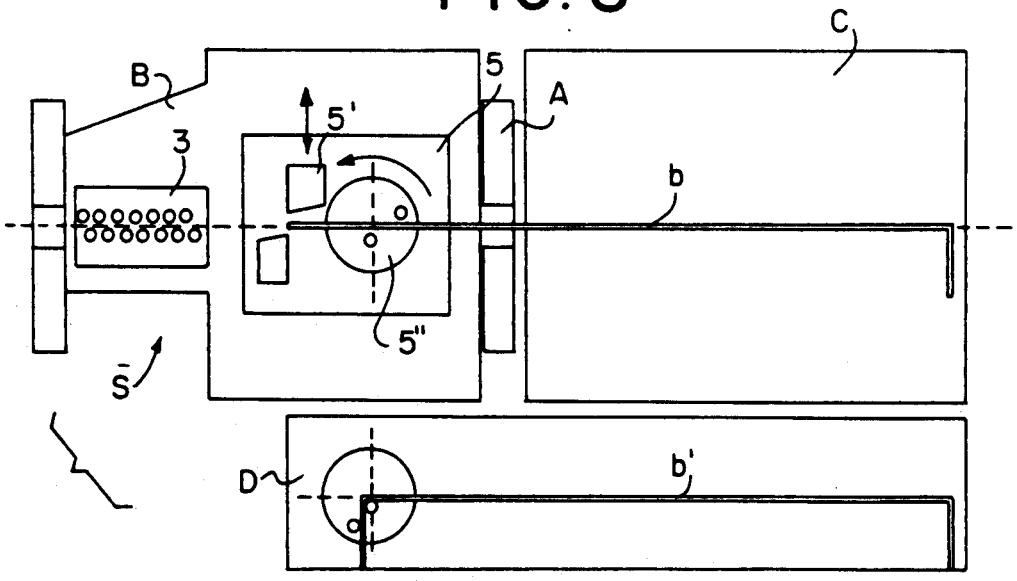

Alternatively as shown in FIG. 9 the rod can be discharged on an auxiliary bending bench (D) adjacent to first bench (B). The auxiliary bench includes similar bending groups can perform opposite bending in the same bar is carried out (b'). The machine utilizes hydraulic motors for all of its operative steps. FIG. 1 as is shown in, the board of hydraulic command, with respective hydraulic oil reservoir is installed into the base, behind the working plane (B). This position is particularly advantageous for added weights on the movable parts of the machine, and for maintaining the oil always in a stationary position.

We claim:

1. A straightening-bending apparatus for wire stock feed comprising in combination, a working table pivotable about a table horizontal axis including:

advancing and straightening means with opposed rolls to straighten and longitudinally advance the wire stock on said working table including guiding means for guiding the feed stock along the working table;

cutting means receiving the wire stock feed from said advancing and straightening means provided on said table for cutting said wire stock feed bending means for bending said stock material receiving said wire stock feed from said cutting means wherein the working table is pivotable at an angle $\beta$ from a generally vertical orientation about said table horizontal axis:

from a first generally horizontal position ($\beta° = 90°$) where the table faces upwardly to a second positive inclined position ($0° < \beta° < 90°$) in which the working table faces forwardly and upwardly with respect to said longitudinal feed path;

to a third vertical position ($\beta° = 0°$) in which the working table faces forwardly with respect to said longitudinal feed path;

to a fourth negatively inclined position ($0° < -\beta° < 90°$) in which the working table faces forwardly and downwardly with respect to said longitudinal feed path, and wherein:

the respective working table is displaced downwardly with respect to the longitudinal feed path when the working table is moved to said third vertical position and said fourth negatively inclined position so that wire stock can free fall downwardly from said straightening means, cutting means and bending means.

2. The straightening-bending apparatus of claim 1, wherein said bending means comprises:

anvil means positionable above or below the wire stock feed to be bent on said pivotable working table; and a rotatable bending nib means rotatable both clockwise and counterclockwise and retractable in conjunction with said anvil means, in order to allow the wire stock feed to be bent alternatively either to left or to right or vice-versa in respect to said anvil means.

3. The straightening-bending apparatus of claim 1, wherein said working table pivoting means includes:

hydraulic-cylinder operating means to pivot said working table; and a board of hydraulic commands and hydraulic oil tank being positioned into the machine remote from said working table.

4. The straightening-bending apparatus of claim 1, wherein said working table in the area of said straightening means is narrowed to form a recess providing for an operator work station.

5. The straightening-bending apparatus of claim 1, wherein downstream of said straightening-bending machine is a bench for supporting an excessive length of the advancing wire stock feed.

6. The straightening-bending apparatus of claim 1, and further including a second working bench with auxiliary bending means for bending the opposite extremity of a cut bar received from feeding means.

* * * * *